US005522593A

United States Patent [19]

Kobayashi et al.

[11] Patent Number: 5,522,593

[45] Date of Patent: Jun. 4, 1996

[54] GOLF CLUB HEAD

[75] Inventors: Kenji Kobayashi; Hitoshi Takeda, both of Tsubame, Japan

[73] Assignee: Kabushiki Kaisha Endo Seisakusho, Japan

[21] Appl. No.: 245,971

[22] Filed: May 19, 1994

[30] Foreign Application Priority Data

| | | | |
|---|---|---|---|
| May 31, 1993 | [JP] | Japan | 5-129608 |
| Aug. 27, 1993 | [JP] | Japan | 5-213039 |
| Mar. 31, 1994 | [JP] | Japan | 6-063532 |
| Mar. 31, 1994 | [JP] | Japan | 6-063538 |

[51] Int. Cl.[6] ..... A63B 53/04

[52] U.S. Cl. ..... 473/349; 473/340; 473/345

[58] Field of Search ..... 273/167 R, 167 F, 273/167 H, 169, 170, 171, 172, 173, DIG. 23, 78, 77 R

[56] References Cited

U.S. PATENT DOCUMENTS

| | | | |
|---|---|---|---|
| 922,444 | 5/1909 | Youds | 273/169 |
| 1,567,248 | 12/1925 | Dahlman | 273/169 |
| 1,678,637 | 7/1928 | Drevitson | 273/169 |
| 1,968,092 | 7/1934 | Oldham . | |
| 1,968,627 | 7/1934 | Young | 273/169 |
| 2,846,228 | 8/1958 | Reach | 273/167 F |
| 3,220,733 | 11/1965 | Saleeby | 273/171 |
| 3,847,399 | 11/1974 | Raymont . | |
| 4,027,885 | 6/1977 | Rogers | 273/167 F |
| 4,326,326 | 4/1982 | MacDonald | 273/167 F |
| 4,523,759 | 6/1985 | Igarashi | 273/169 |
| 4,874,171 | 10/1989 | Ezaki | 273/167 H |
| 4,984,800 | 1/1991 | Hamada | 273/167 F |
| 5,275,413 | 1/1994 | Sprague | 273/171 |

*Primary Examiner*—Sebastiano Passaniti
*Attorney, Agent, or Firm*—Quarles & Brady

[57] ABSTRACT

A golf club head, especially relating to an iron golf club head having a balance weight secured to the back of a head body, provided for improvemnt of securing such balance weight thereto. The back surface of the head body and the front surface of the weight are provided with concave portions opposite to each other, of which the side-peripheral surfaces decrease their cross-widths toward their contact surfaces. Into a space between the back and front surfaces is filled a connecting material such as an adhesive, and then solidified, thereby easily joining the head body to the weight, which can be ensured thanks to dovetail structures of the concave portions.

6 Claims, 16 Drawing Sheets

GOLF CLUB HEAD

BACKGROUND OF THE INVENTION (a) Field of the Invention

The present invention relates to a golf club head, especially relates to so-called iron golf club head or a putter golf club head.

(b) Description of Prior Art

It is mainly for the purpose of both enlarging so-called sweet area and lowering the center of gravity of a golf club head that the weight distribution of golf club head including iron golf club head or the like is adjusted in an inventon relating to a golf club head. It is obvious to those skilled in the art that to enlarge a sweet area, the center of gravity of a club head should be positioned comparatively backward, or else, the weight distribution of golf club head should be concentrated upon a peripheral portiton relative to a face besides the enlargement of a volume of golf club head itself. One of the representative of a means for realizing such weight distribution is disclosed in U.S. Pat. No. 3847399, in which a head body is formed hollow, or a back surface of a club head is formed with a cavity.

Further, another representative of the above-mentioned weight distribution of a club head is disclosed in U.S. Pat. No. 1968092, in which a plurality of members are joined to structure an iron golf club head in order to make it easier to adjust the weight distribution of a club head. According to the disclosed club head, a face member is firmly welded to the front side of a head body having a hosel, while an inserting member is sandwiched between the head body and the face member for firmly combining them. However, the above-mentioned priot art have had problems such as relatively difficult fabrication of a club head as well as low connection strength of each member of a club head, which will at worst, will cause a disassembly or breaking of the club head. Further, according to the prior art, the back surface is formed with a curved surface, which prevents a player from concentrating on a play in "addressing balls". That is, in addressing balls, a player must carefully choose a position of a face relative to a ball, which will be disturbed by the curved back surface as it will become an obstacle to the view.

SUMMARY OF THE INVENTION

To eliminate the above-mentioned problems and improve a means for the weight distribution of a club head, it is, therefore, an object of the present invention to provide a golf club head, of which the balance weight independent of a head body can be easily and firmly secured to the back side thereof.

It is another object of the present invention to provide a golf club head of which the balance weight will not disturve a player's concentration in attending to the address of balls.

According to a major feature of the present invention, a golf club head comrises: a head body, said head body having a first recess at its back, a side-peripheral surface of which having widths decreasing toward a rear direction of a golf culb head; a balance weight to be secured to said head body, said balance weight being formed of denser material than that of said head body, having a second recess at its front side in opposition to said first recess, a side-peripheral surface of which having widths decreasing toward a front direction of a club head; a connecting member to be filled and solidified in a space between said first and second recess, said connecting member being made of adhesive, carbon fiber or the like.

BRIEF DESCRIPTION OF THE DRAWINGS

Other objects, features and advantages of the invention will be apparent to those skilled in the art from the following description of the preferred embodiments of the invention, wherein reference is made to the accopmpanying drawings, of which.

DETAILED DESCRIPTION OF THE PREFERRED EMBODIMENTS

Figures 1, 1A, 1B:
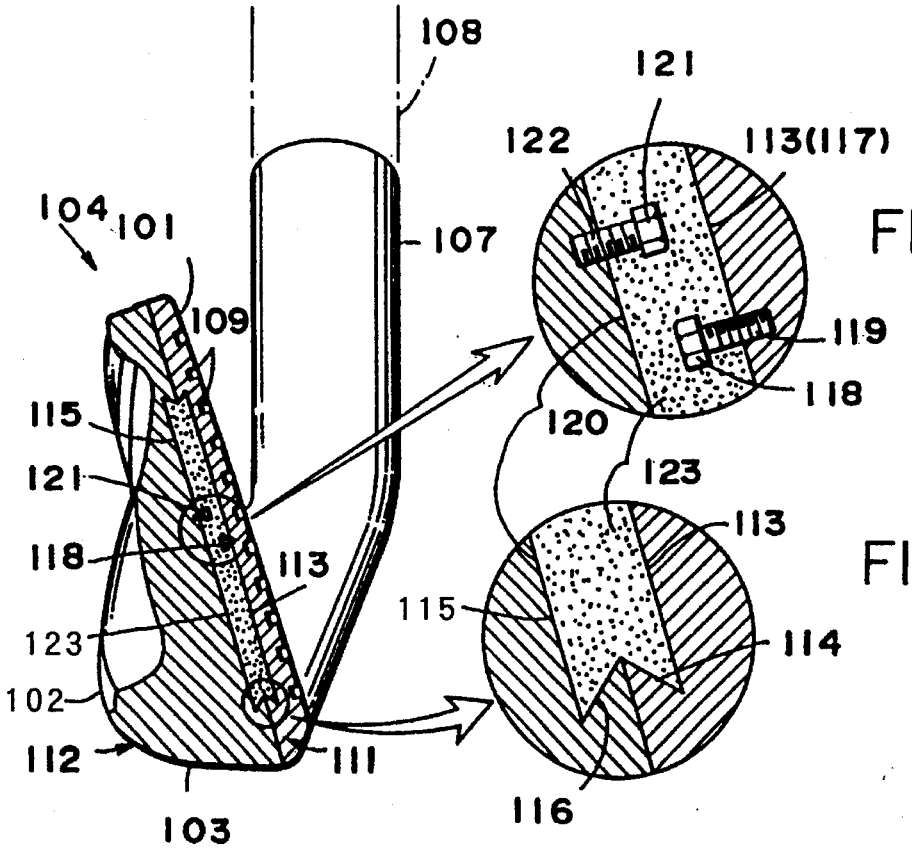
FIG. 1 is a partly enlarged transverse sectional view showing a first embodiment of the invention.
FIG. 1*a* is an enlarged transverse sectional view showing a portion of the first embodiment of the invention.
FIG. 1*b* is an enlarged transverse sectional view showing a portion of the first embodiment of the invention.
Figure 2:
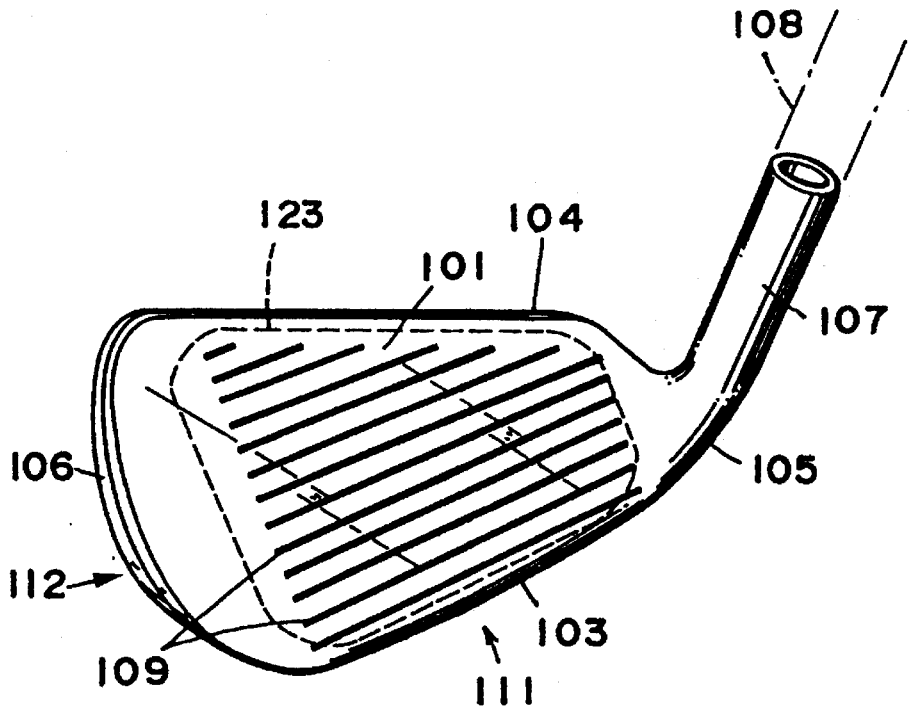
FIG. 2 is a front perspective view showing a first embodiment of the invention.
Figure 3:
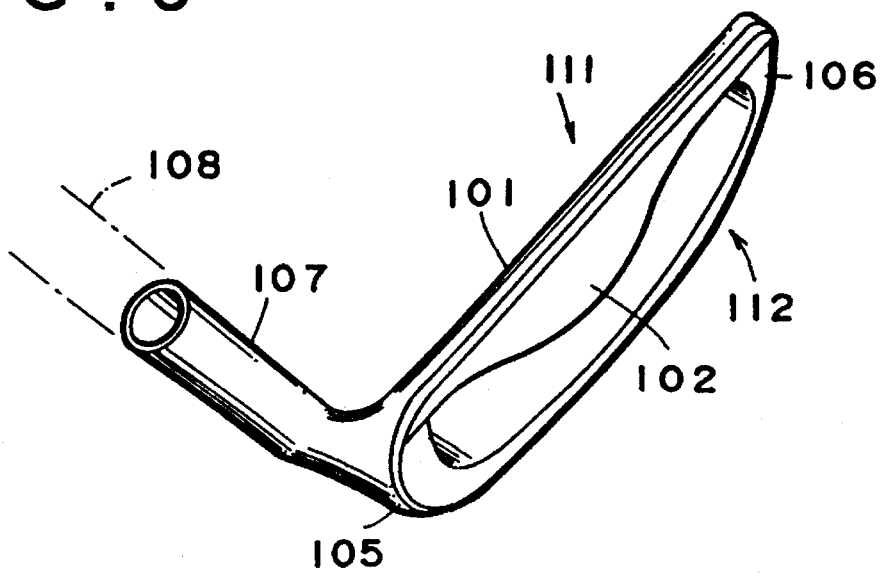
FIG. 3 is a rear perspective view showing a first embodiment of the present invention.

Hereinafter are described embodiments of the present invention with reference to the drawings. All of the following embodiments relate to so called "iron" golf club head except an eleventh embodiment. In reference numerals attached to the drawings, 3 and 4-digit numbers show the number of embodiments, while 1 and 2-digit numbers are designated at common numerals for the same portions in each embodiment, thereby the repeated description will be suitably omitted on or after the description of a second embodiment.

In FIGS. 1 to 4 showing a first embodiment of the invention, reference numeral 101 designates a front face, while 102 designates a back, 103 a sole, 104 a top, 105 a heel at one side, 106 a toe at the other side respectively. From an upper portion of the heel 105, there extends obliquely upward a hosel 107, to which is connected a shaft 108. Said face 101 is provided with grooves 109.

A golf club head shown in this embodiment comprises two components. That is, a tabular head body 111 and a balance weight 112 secured to a back side of the head body 111. The head body 111 defines a face 101 and a front part of a sole 103, top 104, heel 105 and toe 106 respectively, having a hosel 107 integral therewith. The head body 111 is formed, for instance, of metallic material having comparatively a small specific gravity such as pure titanium, titanium alloy or aluminum alloy. On the other hand, weight 112 defines a back 102 and a back part of a sole 103, top 104, heel 105 and toe 106 respectively. Whereas, weight 112 is formed, for instance, of metallic material having a comparatively greater specific gravity such as iron, stainless steel, beryllium copper alloy or copper alloy.

The back surface of head body 111 is formed with a first recess 113. A side-peripheral surface 114 of the first recess 113 is provided so as to be disposed nearly along a peripheral edge of the face 101. A whole portion or a part of the side-peripheral surface 114 decreases its cross-width toward the back, i.e., tapers from the front toward the back. Similarly, a front side of weight 112 is formed with a second recess 115, of which the side-peripheral surface 116 increases its cross-width toward the back as well, opposite to the side-peripheral surface 114. Further, into a bottom surface 117 of the first recess 113 is screwed screw 119 having its head 118, while into a bottom surface 120 of the second recess 115 is screwed screw 122 having its head 121.

The back surface of head 111 is joined to the front surface of weight 112 so that there is formed a hollow poriton defined by the first and second recesses 113,115, which is filled with adovetail-like connecting member 123 of a solidified adhesive and/or carbon fiber, thus integrally connecting the head body 111 to the weight 112.

Figure 4:
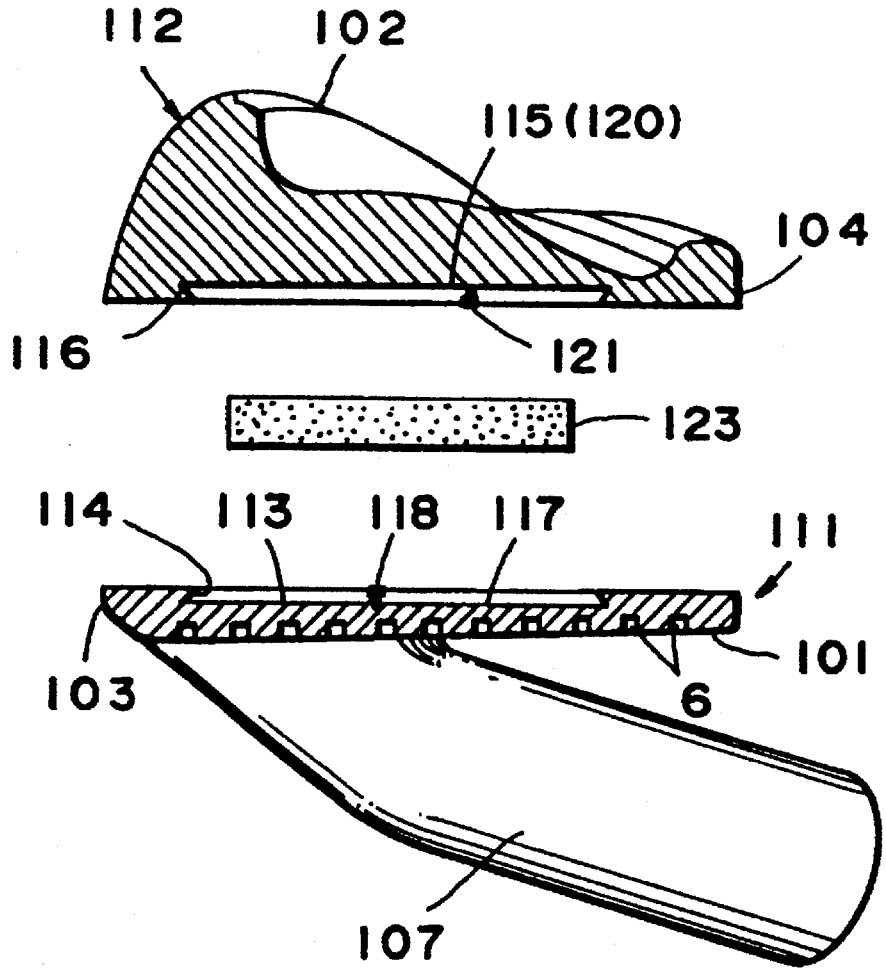
FIG. 4 is a transveree sectional view illlustrating a fabrication of a golf club head of a first embodiment of the invention.

Hereinafter is described its manufacturing method with reference to FIG. 4. The first recess 113 is turned upward to set the head body 111 in a fixture (not shown). Thereafter, a sufficient quantitiy of the pre-heated and softened connecting member 123 is placed onto the first recess 113, which is then, covered with the weight 112 and pressed downward therefrom, so that the connection member 123 closely fills a hollow portion between the first and second recesses 113, 115. At that time, the connection member 123 reaches every corner of docetail-like side-peripheral surfaces 114, 116 of the recesses 113, 115. After that, the connection member 123 is left at an ordinary temparature for solidification for a predetermined time, with the same being still pressed. Such solidified connection member 123 having a dovetail-like configuration allows the head body 111 to be firmly secured to the weight 112, though the material of the former is different than that of the latter.

In addition, in the case that the connecting member 123 is an adhesive, pre-treatment is preformed such as solvent-degreaseing of inorganics such as rust, or organic substance such as fats and oils after abrasion, or chemicals treatment after solvent-degreasing.

The adhesive is preferably a thermosetting resin adhesive, blended adhesive or thermoplastic resin adhesive, which fills a hollow portion to be solidified within a temparature range of 20 to 120 deg under a pressure condition of 10 ton/cm$^2$ or above. On the other hand, in the case that the connection member 123 is an carbon fiber, the aforementioned pre-treatmemt is performed as well, and then, carbon fiber and adhesive are mixed with a ratio from 50:50 to 20:80 by weight, which fills a hollow poriton to be solidified within a temparature range of 100 to 200 deg, under a pressure condition of 10 ton cm$^2$ or above. After the above-mentioned integrating process, a part of the connecting member 123 pushed out from between integrated head body 111 and weight 112 is removed by wiping or polishing or the like to a final product.

As described above, the weight 112 is provided at the back side of head body 111 having comparatively smaller specific gravity than the weight 112, whereby the center of gravity of a club head can be positioned still backward to enlarge a sweet area. Further, the head body 111 can be easily secured to the weight 112 merely by charging and solidifying the connecting member 123 such as adhesive and/or carbon fiber into a space defined by the head body 111 and weight 112, which can be more firmly secured by dovetail-like shaped recesses 113, 115, even if their materials are different. Furthermore, as there is provided the screw 119 having the head 118 in the bottom surface 117 of the first recess 113, while there is provided another screw 122 having the head 121 in the bottom surface 120 of second recess 115, the heads 118, 121 are embedded in the connecting member 123, whereby screws 119, 122 can be prevented from being loose, so that a greater connection strength can be obtained.

Figures 5, 5A:
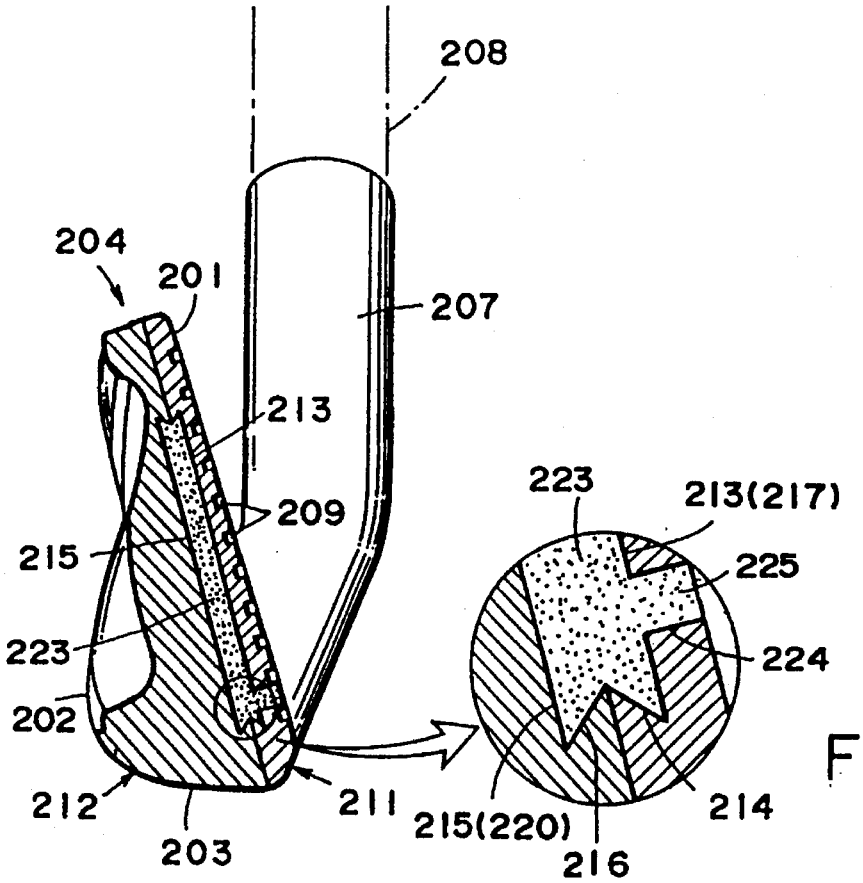
FIG. 5 is a partly enlarged transverse sectional view showing a second embodiment of the present invention.
FIG. 5*a* is an enlarged transverse sectional view showing a portion of the second embodiment of the invention.

In FIG. 5 and 5*a* showing a second embodiment of the invention, there is provided a transversely elongated window-shaped aperture 224 extending up to a face 201 at a lower portion of a first recess 213 of a head body 211. And into the aperture 224 is inserted connecting member 223 of carbon fiber to form an exposed portion 225. The exposed portion 225 is positioned on approximately the same plane relative to the face 201 to define a part thereof.

When a ball is hit by a player, it will be liable to spin or ratate by the face 201 of pure titanium or titanium alloy. The exposed portion 225 of carbon fiber (or connecting member 223) can control its spin or rotation of a ball, thereby generating a tendency to elongate a flying distance of a hit ball. Accordingly, any suitable golf club heads can be supplied for each player by adjustment of an area ratio of the exposed portion 225 to the face 201.

Figure 6A:
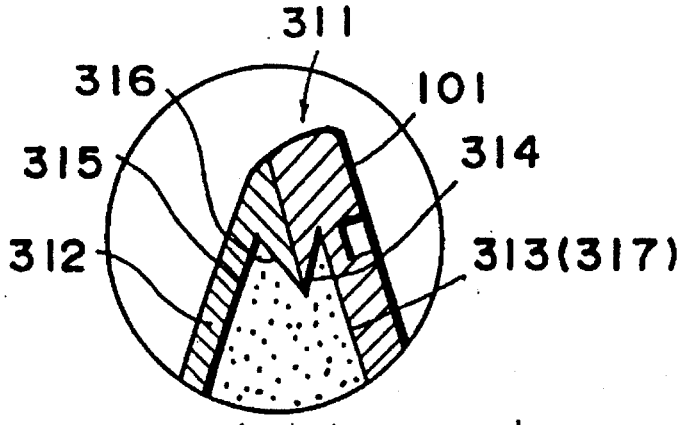
FIG. 6*a* is an enlarged transverse sectional view showing a portion of the second embodiment of the invention.
Figure 6:
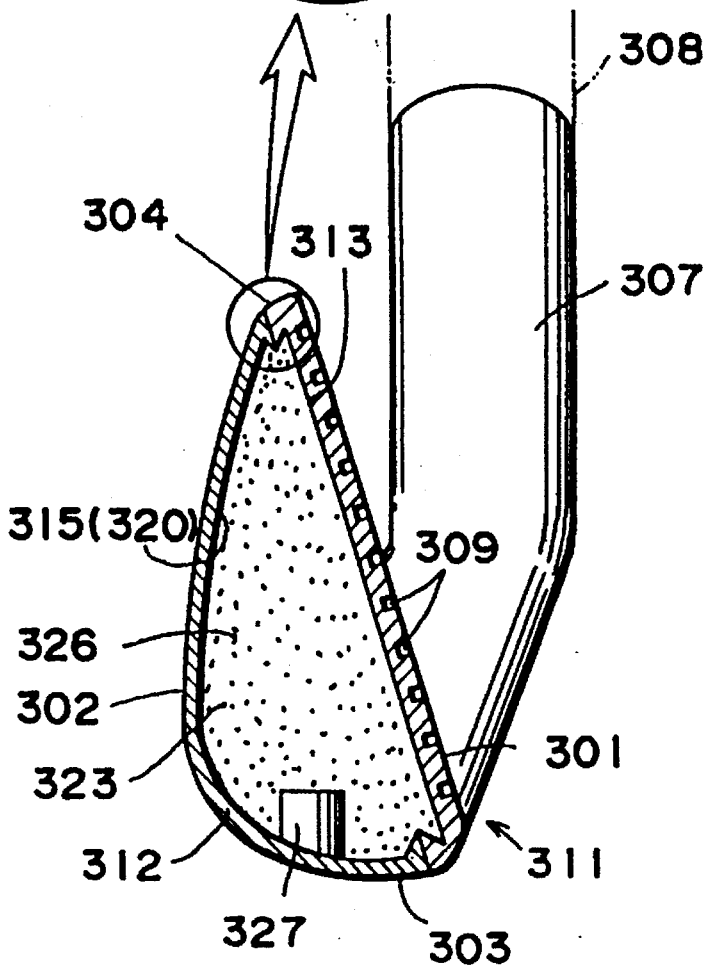
FIG. 6 is a partly enlarged transverse sectional view showing a third embodiment of the present invention.

In FIG. 6 and 6*a* showing a third embodiment of the invention, there is provided comparatively a large hollow interior 326 defined by head body 311 and weight 312. The hollow interior 326 is mainly formed by a second recess 315 at a weight 312 side, having a volume of 45 to 65, preferably nearly 53 cubic centimeters. On a sole 303 of the weight 312 within the hollow interior 326 is provided a sub-weight 327 for lowering the center of gravity of a club head. The connecting member 323 such as adhesive and/or carbon fiber is also filled in the hollow interior 326.

With the structure thus made, even for a hollow golf club head. the weight 312 can be secured to the back side of the head body 311 by means of the connecting member 323 of adhesive and/or carbon fiber. Incidentally, in the above-mentioned embodiments, materials of head body and weight should not be limited to metallic ones, but synthetic resin may be also employed.

Figure 7:
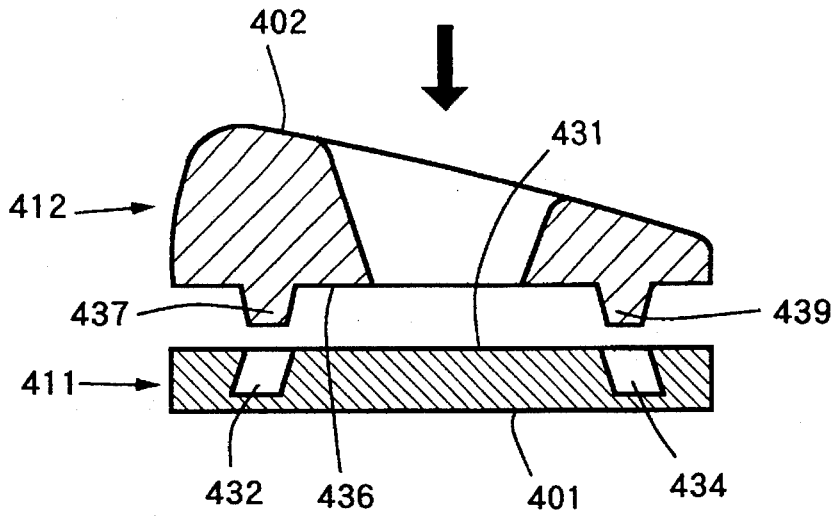
FIG. 7 is a transverse section showing a fourth embodiment of the invention, illustrating a head body before securing a balance weight thereto.
Figure 8:
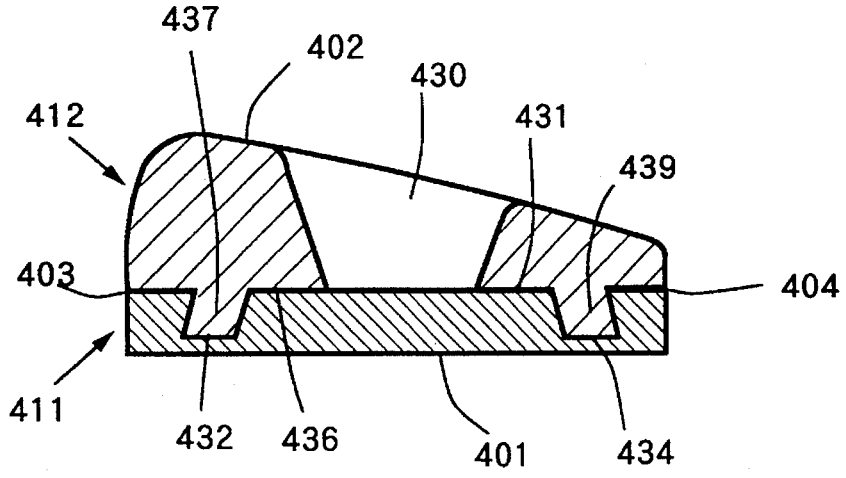
FIG. 8 is a transverse section showing a fourth embodiment of the invention, illustrating a head body after having secured a balance weight thereto.
Figure 9:
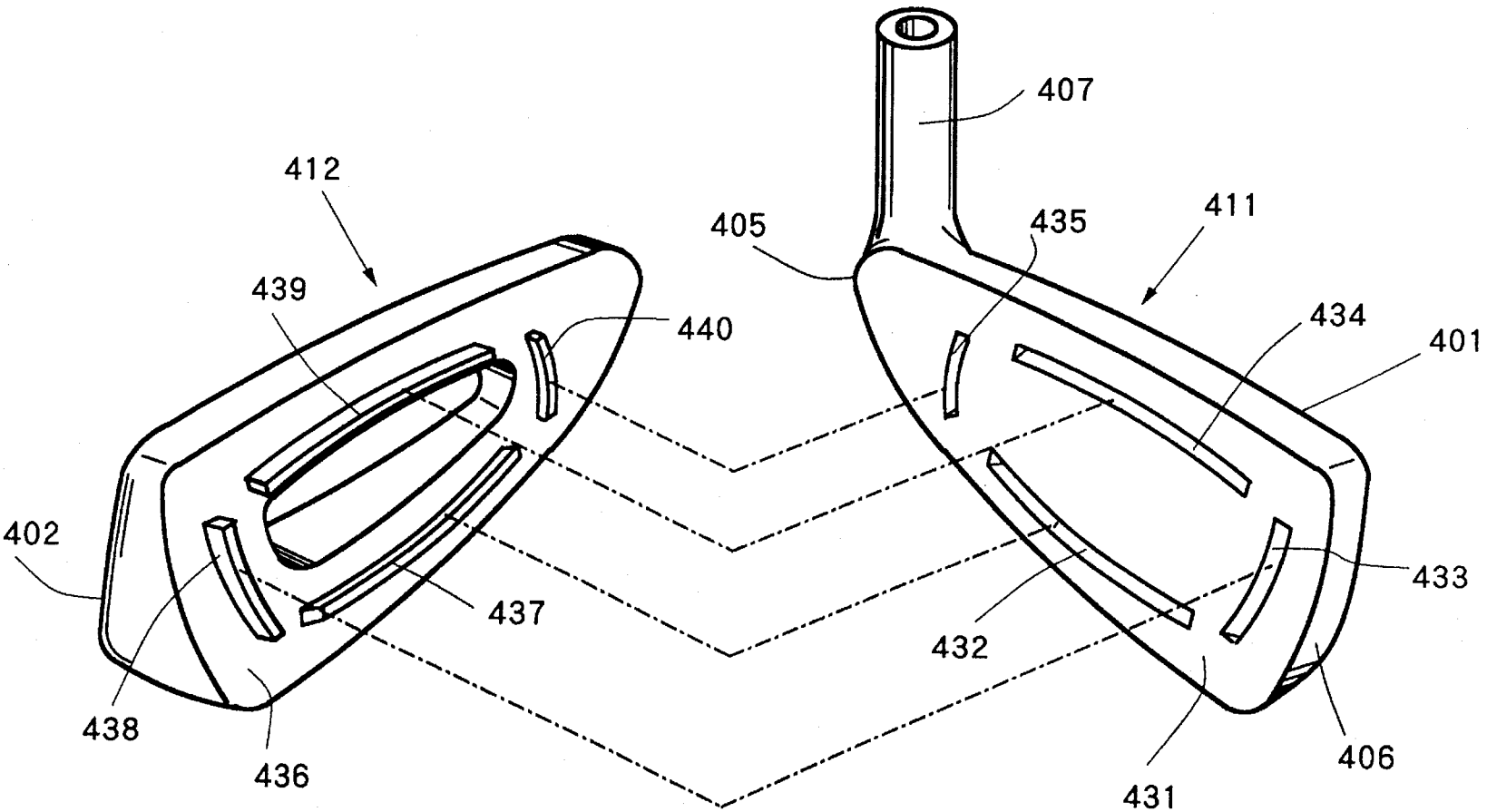
FIG. 9 is a perspective view showing a fourth embodiment of the invention, illustrating a head body and balance weight, which are not still secured to each other.

In FIGS. 7 to 9 showing a fourth embodiment of the invention, a head body 411 and weight 412 are manufactured by press working, forging or cutting work to be joined together. The weight 412 is formed annular, thus forming a cavity 430 in the center of a back 402. As shown in FIG. 8, prior to the joining of the head body 411 to the weight 412, the back surface of the head body 411, i.e., a contact surface 431 against weight 412, is formed with a plurality of concave grooves 432, 433, 434, 435. On the other hand, the front surface of the weight 412, i.e., a contact surface 436 against the head body 411, is formed with a plurality of convex bars 437, 438, 439, 440, which are pressed into the corresponding concave grooves. These concave grooves 432, 433, 434, 435 and convex bars 437, 438, 439, 440 are located at a sole 403 side, toe 406 side, top 404 side and heel 405 side of the contact surfaces 431 and 436 resepectively, and that they are slightly U-shaped relative to the center of the contact surfaces 431, 436, which, alternatively, may be straightened.

The concave grooves 432, 433, 434, 435 are sloped outwardlyor centrifugally in the front direction of the contact surface 431. In other words, they extend radially toward the front direction. Whereas, the convex bars 437, 438, 439, 440 are provided so as to be perpendicular to the contact surface 436, although they slightly taper. And here, each convex bar 437, 438, 439, 440 has slightly a less width than each concave groove 432, 433, 434, 435, while each convex bar is a little higher than each concave groove.

In joining the head body 411 to the weight 412, as shown in FIG. 7, the weight 412 is pressed to the head body 411 perpendicularly to the contact surfaces 431, 436 by means of a pressing device. Accordingly, each convex bar 437, 438, 439, 440 of the weight 412 is pressed into each corresponding concave groove 432, 433, 434, 435 respectively. At this time, as described above, the concave grooves are sloped relative to the contact surface 431, while initially provided convex bars 437, 438, 439, 440 are formed perpendicular to the contact surface 436, whereby there will occur a plastic deformation in the convex bars during being pressed into corresponding concave grooves. In other words, as shown in FIG. 7, the convex bars innitially provided to be perpendicular to the contact surface 436 are generally bent centrifugally uniti they are finally inclined outwardly as well as the concave grooves, as shown in FIG. 8.

With the structure thus made, convex bars 437, 438, 439, 440 are firmly caulked into corresponding concave grooves 432, 433, 434, 435 so that they are prevented from being loosened. In addition, as four concave grooves 432, 433, 434, 435 for pressing-in of corresponding convex bars 437, 438, 439, 440 have radially distributed inclination relative to the contact surfaces 431, 436, a stiff engagememnt of convex bars 437, 438, 439, 440 with concave grooves 432, 433, 434, 435 can be obtained such that the head body 411 can be firmly and easily secured to the weight 412 without any auxiiliary means such as welding or screws.

Further, as the head body 411 made of titanium alloy is provided with concave grooves, while the weight 412 made of beryllium copper alloy, which is softer than titanium alloy, is provided with convex bars, thus the convex bars can be more easily plastically deformed to enable the easier securing of the head body 411 to the weight 412. Furthermore, as the weight 412 is formed annular, the weight distribution of the whole head body can be further shifted toward the peripehral poriton thereof relative to the face 401, thereby further enlarging a sweet area.

Figure 10:
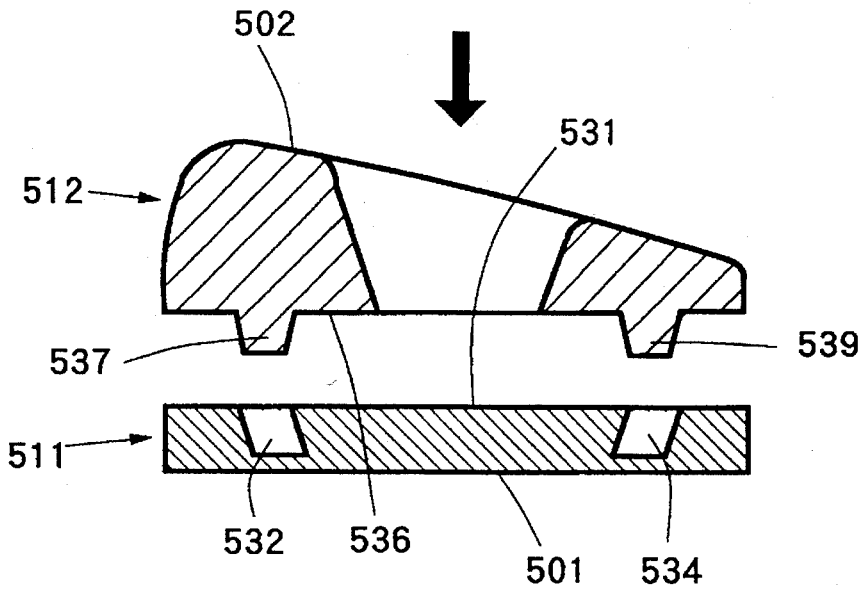
FIG. 10 is a transverse section showing a fifth embodiment of the invention, illustrating a head body before securing a balance weight thereto.
Figure 11:
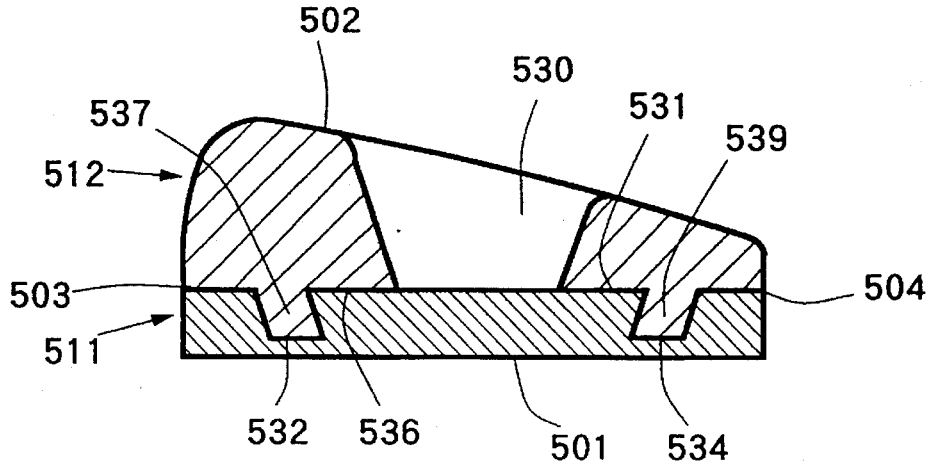
FIG. 11 is a transverse section showing a fifth embodiment of the inveniton, illustrating a head body after having secured a balalance weight thereto.
Figure 12:
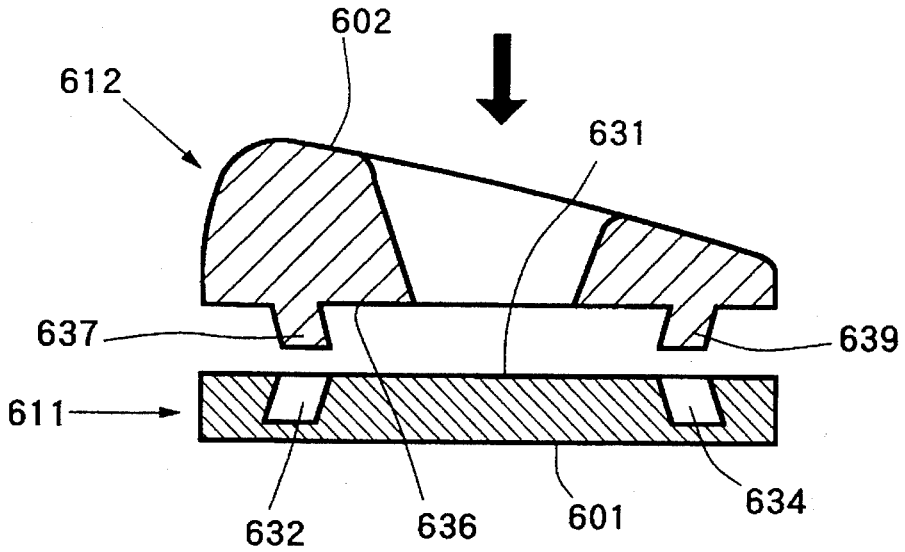
FIG. 12 is a transverse section showing a sixth embodiment of the invention, illustrating a head body before securing a balance weight thereto.
Figure 13:
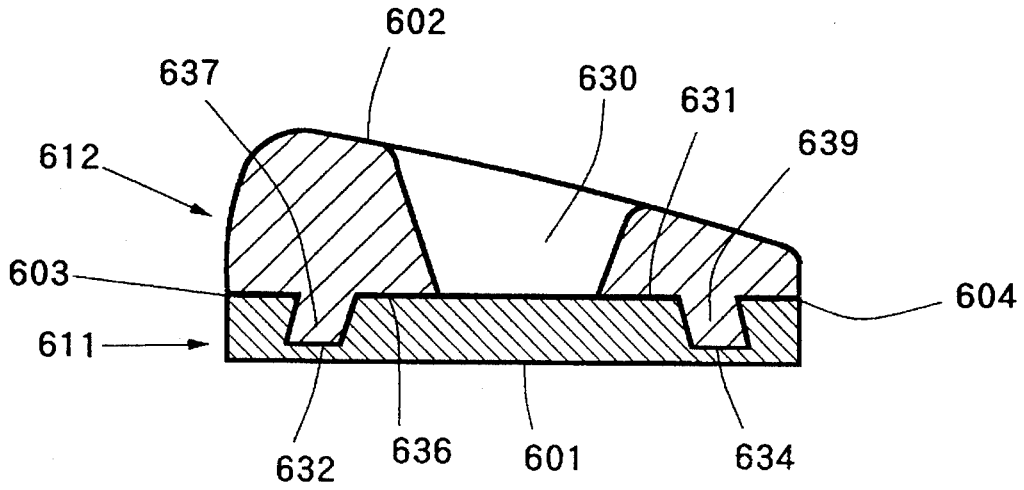
FIG. 13 is a transverse section showing a sixth embodiment of the invention, illustrating a head body after having secured a balance weight thereto.

Incidentally, configurations of concave grooves and convex bars, their positions and directions relative to contact surfaces should not be limited to those described in a fourth emobodiment. For example, in FIGS. 10 and 11 showing a fifth embodiment of the invention, concave grooves 532, 534 are inwardly or centripetally sloped in the front direction as a whole relative to a contact surface 531. Whereas, in FIGS. 12 and 13 showing a sixth embodiment of the invention, prior to the joining of a head body 611 to a weight 612, each convex bar 637, 639 is sloped the other way with respect to corresponding each concave groove 632, 634. In addition, though it is desirable to provide a plurality of plastic-deformable convex bars, each corresponding concave poriton may be formed annular, i.e., sequently connected to form an anular groove (but not circle-shaped).

Figure 14:
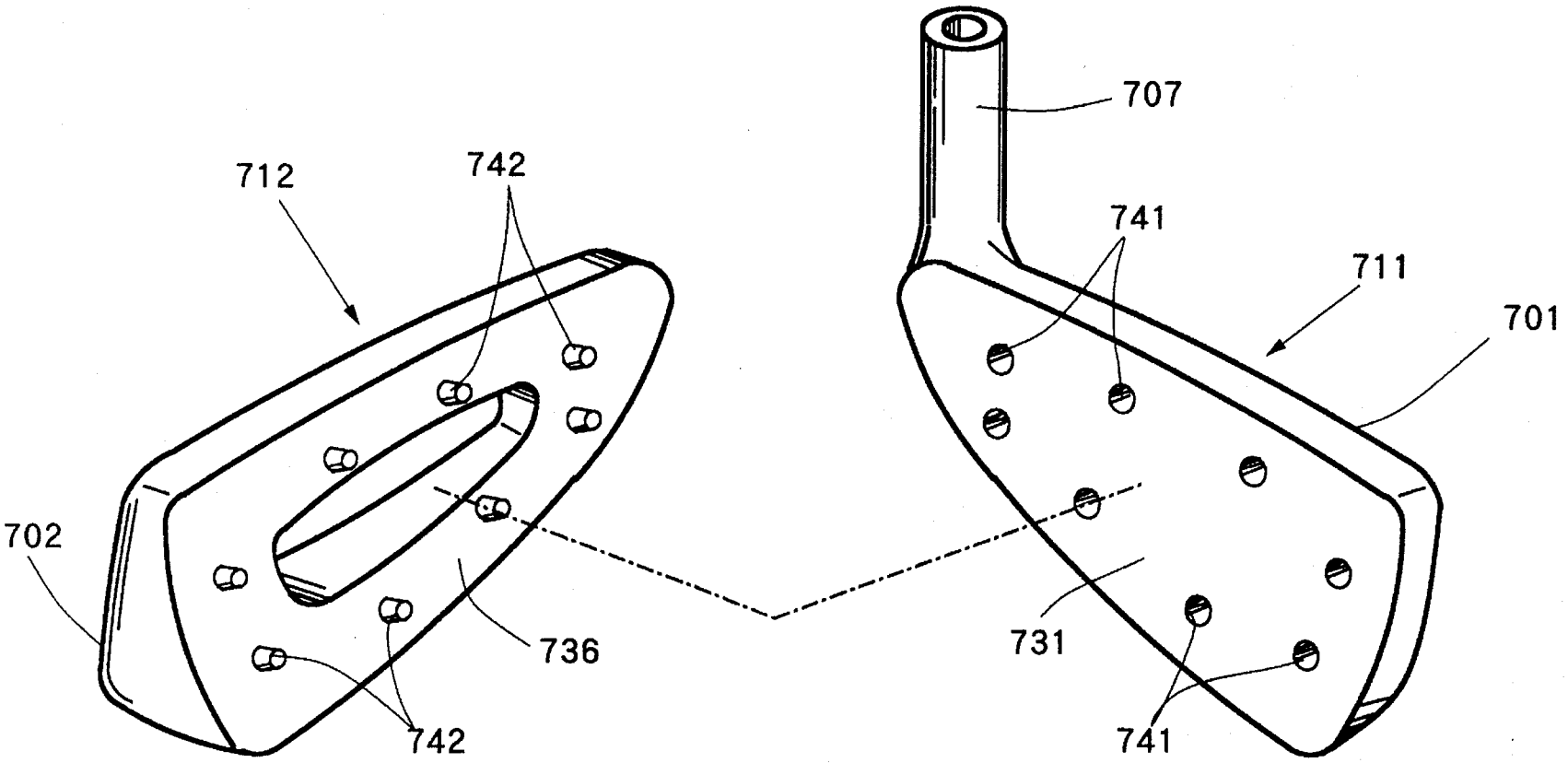
FIG. 14 is a perspective view showing a seventh embodiment of the invention, illustrating a head body and balance weight, which are not still connected each other.

Furthermore, in FIG. 14 showing a seventh embodiment of the invention, a plurality of concave portions formed in a contact surface 731 of a head body 711 are provided as a plurality of concave holes 741, while a plurality of convex portions formed in a contact surface 736 of a weight 712 are provided as a plurality of pin-like protrusions 742. The multiple concave holes 741 disposed along a peripheral edge of the contact surface 731 are outwardly inclined in the front direction as a whole. On the other hand, prior to the joining of the head body 711 to the weight 712, the multiple protrusions 742, having slightly tapered ends, are formed perpendicular to the contact surface 736. With the structure thus made, by means of a pressing device, a plurality of protrusions 742, which are being subjected to plastic deformation, are pressed into the corresponding concave holes 741, thereby securing the head body 711 to the weight 712, of which the effects are the same as those described in a fourth embodiment.

Contrary to fourth to seventh embodiments, convex portions may be formed in a head body, while concave poritons may be formed in a weight. However, in such a case, it is desirable to form convex poritons from a softer member because plastic deformation will easily occur. Additionally, both of concave poritons and convex portions may be provided both for a head body and a weight.

In FIGS. 15 to 18 showing an eighth embodiment of the inventon, a disclosed golf club head also comprises a head body 811 and an annular weight secured to the back side thereof. The back surface of the head body 811 is formed with stepped surfaces: a first flat surface 845 located around the most outer peripheral edge, having an first reverse-tapered side-surface bending from the inner peripheral edge of the first surface 845 toward the back side; a second flat surface 847 extending from the end of the first reverse-tapered side-surface 846 toward the inner periphery side, having a second reverse-tapered surface 848 bending from the inner periphery of the second surface 847; a third flat surface 849 extending from the end of the second reverse-tapered side-surface 848 toward the inner periphery side, having a cylindrical surface 850 bending from the inner periphery of the third surface 849 toward the back side. The two reverse-tapered side-surfaces 846, 848 are so provided that the cross-width of the stepped portions may increase toward the back.

Incidentally, in the present embodiment, if al designates a distance between the front surface of head body 811 and the first flat surface 845, a2 designates a distance between the first and second flat surfaces 845, 847, a3 designates a distance between the second and third flat surfaces 847, 849, a4 designates a distance between the the third flat surface 849 and the back surface of head body 811, while b1, b2, c1, c2, d1, d2 and d3 designatedisrete widths of the first flat surface 845, second flat surface 847 and third flat surface 849 at each sole 803 side, toe 806 side and top 804 side, the values are preferably as follows:

a1=4 mm, a2=a3=a4=3 mm, b1=5 mm, b2=3 mm, c1=5 mm, c2=3 mm, d1=4 mm, d2=d3=3 mm, which, of course, should not be limited to the above values.

On the other hand, the front periperal portions of the weight 812 is so formed as to be an inversion of the back peripheral portons of the head body 811, comprising: a first flat surface 851; a first tapered side-surface 852; a second flat surface 853; a second tapered side-surface 854; a third flat surface 855; an aperture 856 having a cylindrical or pole surface therearound to make the weight annular, thereby defining a cavity in the center of the back side of a club head.

Figure 15:
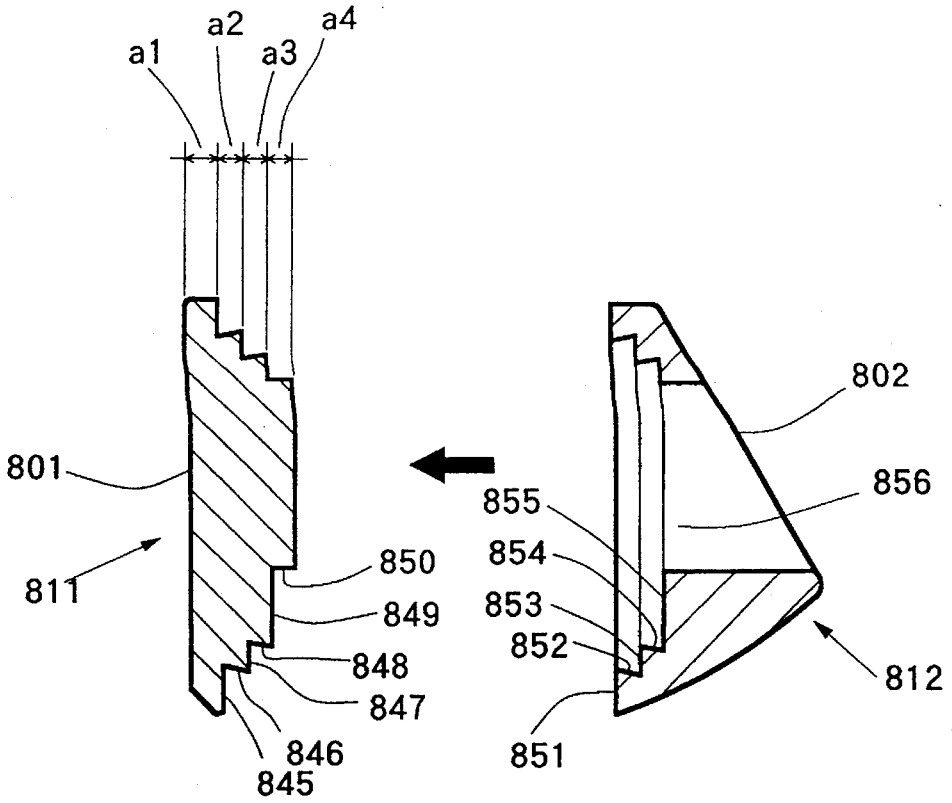
FIG. 15 is a transverse section showing an eighth embodiment of the invention, illustrating a head body before connecting a balance weight thereto.
Figure 16:
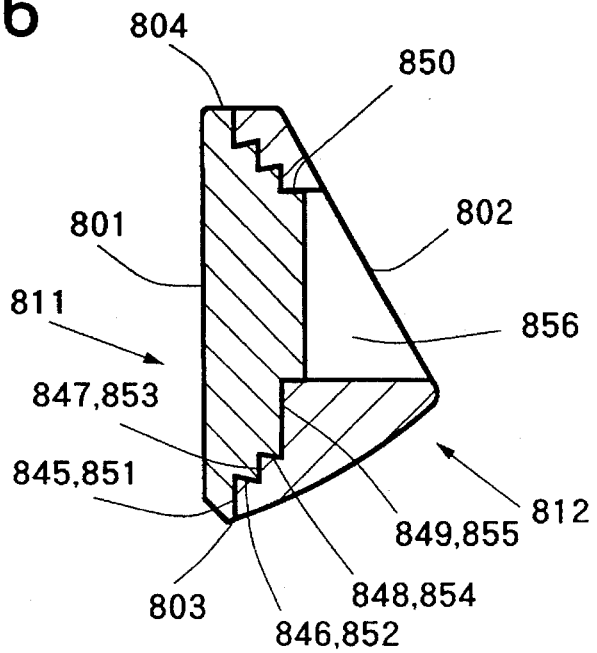
FIG. 16 is a transverse section showing an eighth embodiment of the invention, illustrating a head body after having connected a balance weight thereto.
Figure 17:
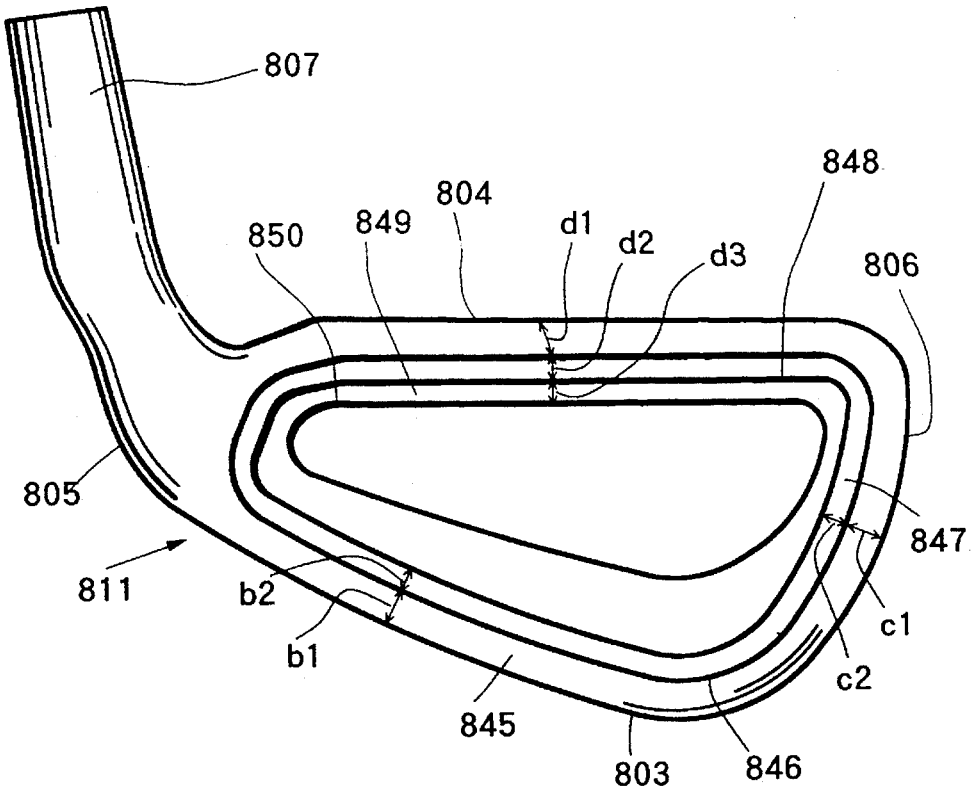
FIG. 17 is a rear view showing a head body of an eighth embodiment of the invention.
Figure 18:
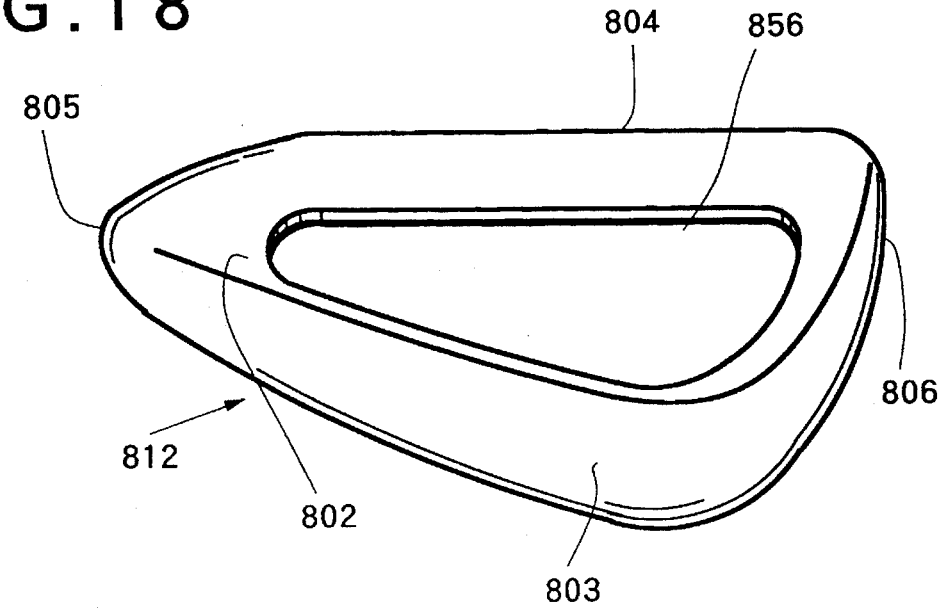
FIG. 18 is a rear view showing a balance weight of an eighth embodiment of the invention.

With the structure thus made, the head body 811 and weight 812 are manufactured by press working, forging or cutting work, and then, joined together. As shown in FIG. 15, in joining them, the head body 811 and weight 812 are pressed in the perpendicular direction relative to the flat surfaces 845, 847, 849, 851, 853, 855, whereby the head body 811 and weight 812, being subjected to elastic or plastic deformation, are forced to join each other. Finally, as shown in FIG. 16, the first, second and third flat surfaces 845, 847, 849 of the head body 811 are brought face to face with first, second and third flat surfaces of the weight 812 respectively, and then the first and second reverse-tapered side-surfaces 846, 848 of the head body 811 are pressed into the first and second tapered side-surfaces 852, 854 of the weight 812 respectively. At the same time, the cylindrical surface 850 of the head body 811 is fitted into the aperture 856 of the weight 812 so that the front side thereof may be closed. According to the above-described manner, the head body 811 and weight 812 are easily and firmly secured, which can be further ensured by the wedge structure of reverse or forward-tapered surfaces 846, 848, 852, 854.

According to the structure thus made, the head body 811 and weight 812 can be easily and firmly secured by pressing the latter into the former. In fabrication, as the back portion of the head body 811 and the front portion of weight 812 are simply step-formed, these portions can be easily fabricated. Further, as these stepped portions comprise as many as three steps, the proportion of the head body 811 to the weight 812 can be made greater in the upper portion of a club head, thereby lightening the upper portion in order to lower the center of gravity of a club head.

Figure 19:
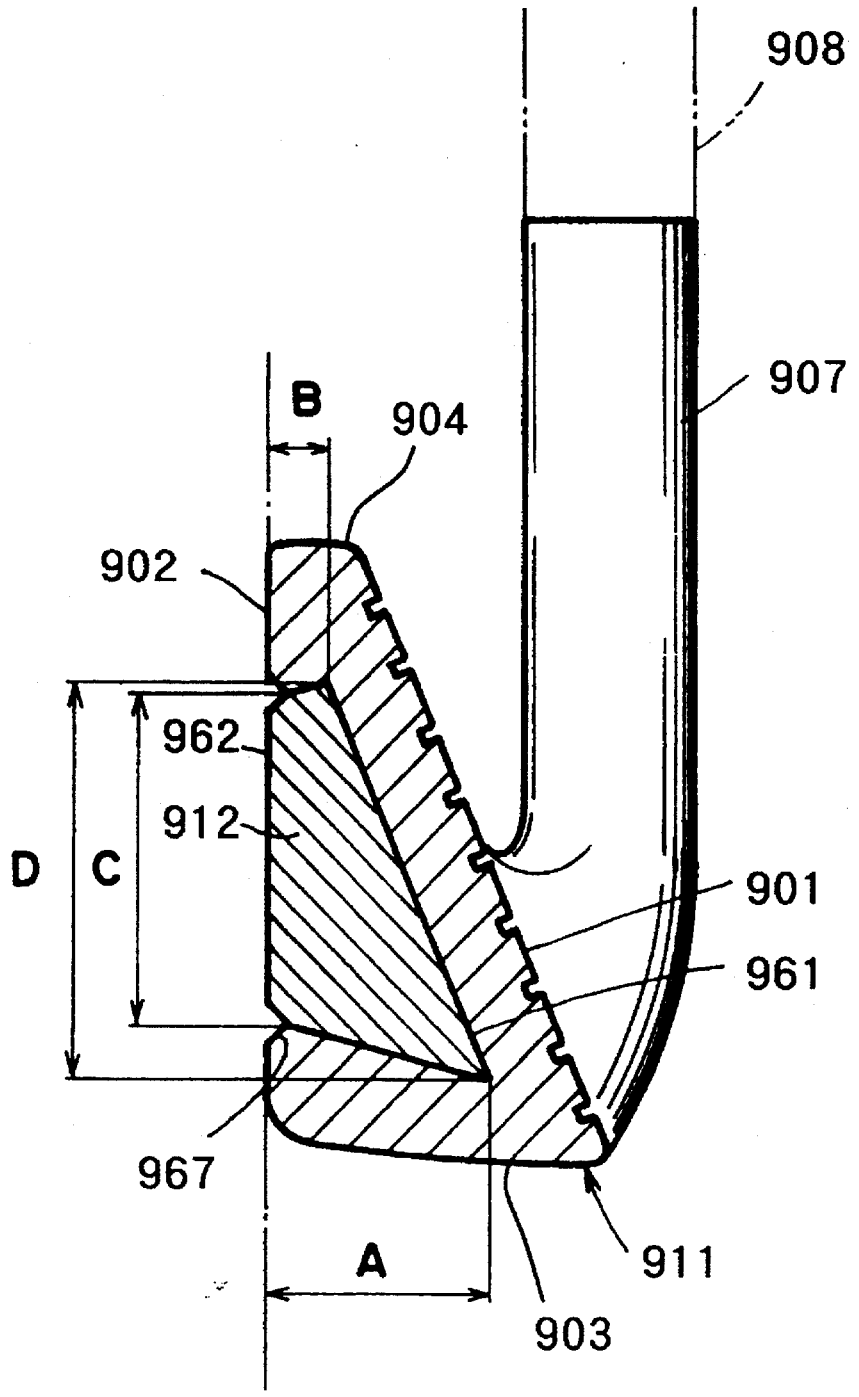
FIG. 19 is a transverse section showing a ninth embodiment of the invention.
Figure 20:
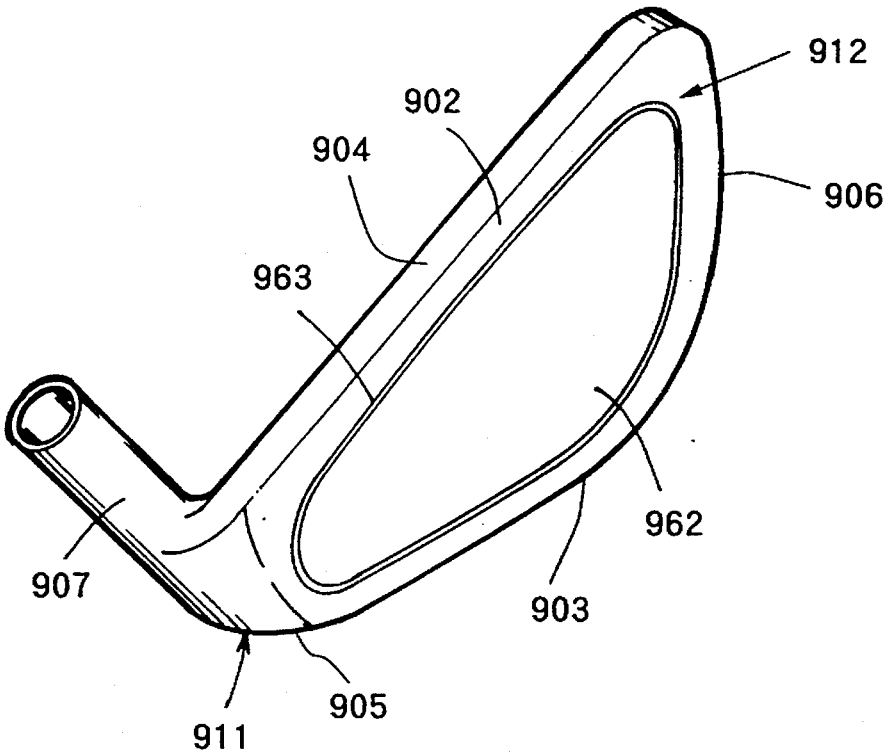
FIG. 20 is a rear perspective view showing a ninth embodiment of the invention.

In FIGS. 19 and 20 showing a ninth embodiment of the invention, a denser weight 912 is also secured to the back side of a head body 911, which is provided with a concave portion 961 in its back 902. The depth A of a lower portion of the concave portion 961 is formed greater than the depth B of the upper portion thereof, while the height D of the inside or front portion greater than the height C of the outside or back portion thereof.

The weight 912 to be provided in the concave portion 961 is formed of comparatively denser materials, such as iron, copper, beryllium copper alloy or lead, which is pressed into the concave portion 971 by means of a pressing device or the like for securing the same to the head body 911. In such pressing-in and securing operation, the back surface 902 of the head body 911 is formed on the same plane relative to the back surface 962 of the weight 912, as shown in a dotted line of FIG. 19. In the boundary portion of back surfaces 902 and 962 are provided a small groove 963 having V-shaped section as an ornament, which is colored red or the like (not shown).

With the structure thus made, weight 912 can be easily combined with head body 911 merely by pressing into concave portion 961 of head body 911. Further, the concave portion 961 has such a dovetail structure that the lower depth A is formed greater than the upper depth B, while the comparatively inside height D greater than the comparatively outside height C, hereby ensuring the securing of the head body 911 to the weight 912, and positioning the center of gravity of a club head more backward and lower than that of the weight 912 itself, so that a sweet area can be further enlarged. In addition, as the back surface 902 of the head body 911 are provided evenly with respect to the back surface 912 of the weight 912, there will be no obstacles to the view in the back portion of a club head, so that a player can enhance his concentration in addressing balls.

Figure 21:
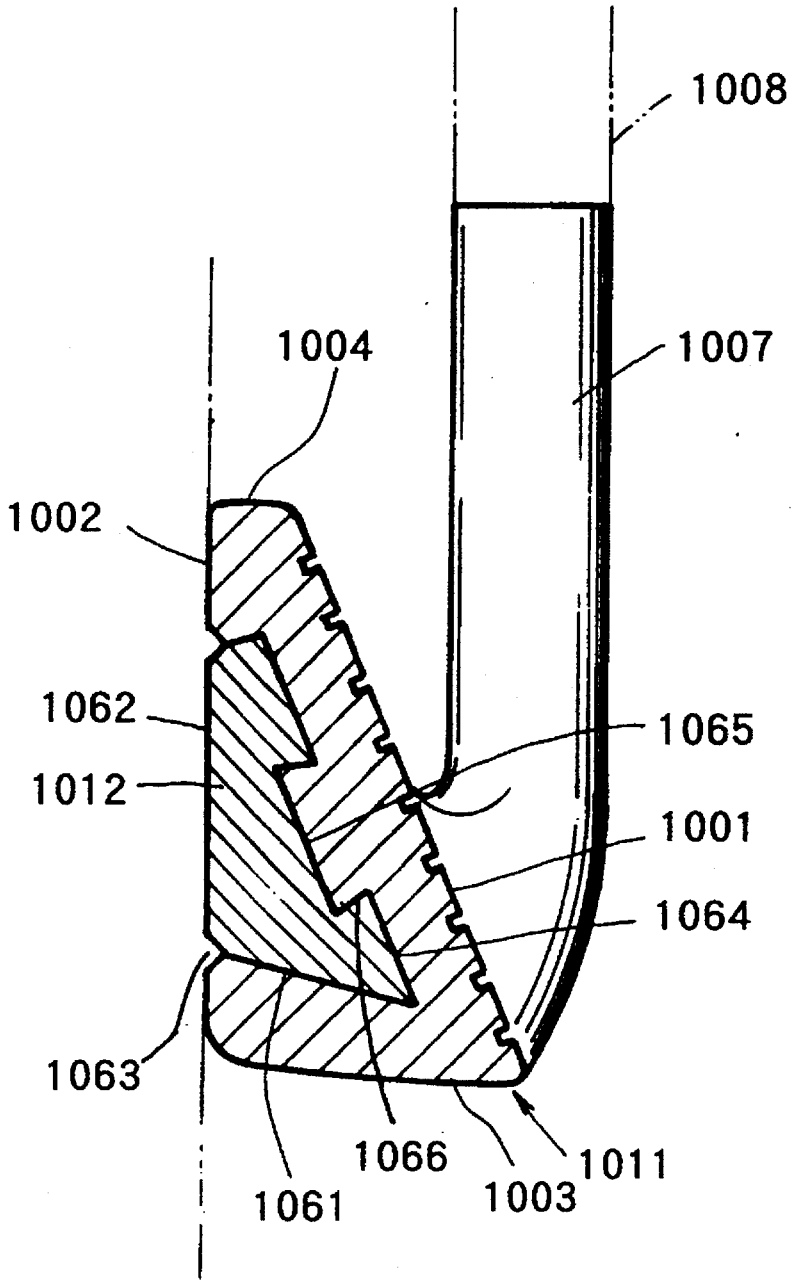
FIG. 21 is a transverse section showing a tenth embodiment of the invention.

In FIG. 21 showing a tenth embodiment of the invention, there is provided a convex portion 1065 protruding backward from approximately the center of a bottom surface 1064 of a concave portion 1061 formed in a head body 1011. The cross-width of the side-surface 1066 of the convex portion 1065 generally increases toward the back, i.e., formed reverse-tapered. A weight 1012 can be also secured by this dovetail-shaped convex portion 1065. And similarly to a ninth embodiment, a back surface 1002 of the head body 1011 is formed on the same plane relative to a back surface 1062 of the weight 1012.

Figure 22:
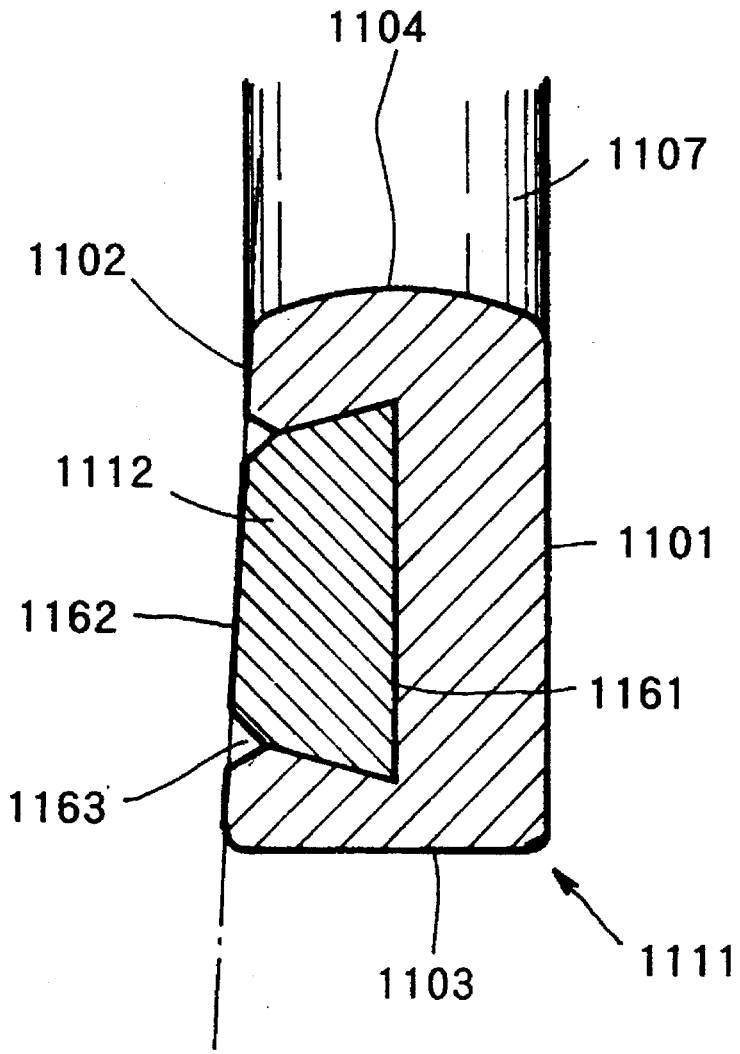
FIG. 22 is a transverse section showing an eleventh embodiment of the invention.

In FIG. 22 showing an eleventh embodiment of the invention, the same structure as that shown in a tenth embodiment is applied to a putter golf club head. That is, there is provided a concave portion 1161 in a head body 1111, into which is pressed a weight 1112 for securing the same to a head body 1111. Similarly, each structure shown in each foregoing embodiment can be applied to not only an iron golf club head but a putter golf club head.

What is claimed:

1. A golf club head comprising:

(a) a head body having a back, said head body having a first recess at the back, a side-peripheral surface of said back having a cross-sectional width decreasing toward a rear direction of the golf head;

(b) a balance weight to be secured to said head body, said balance weight being formed of denser material than that of said head body, said balance weight, having a front having a second recess in opposition to said first recess, a side-peripheral surface of said balance weigh, having a cross-sectional width decreasing toward a front direction of the club head;

(c) a connecting member to be filled and solidified in a space defined by said first and second recesses, said connecting member being made of adhesive, carbon fiber or the like.

2. A golf club head comprising:

(a) a head body, said head body having one contact surface for contacting against a balance weight;

(b) a balance weight to be secured to said head body, said balance weight being formed of denser material than that of said head body, having a second contact surface against said head body;

(c) a plurality of protrusions provided on one of said two contact surfaces;

(d) a plurality of recesses provided on the other of said two contact surfaces, each of said recesses obliquely extending either inwardly or outwardly for pressing into said protrusions, with said protrusions being subjected to a plastic deformation as a whole.

3. A golf club head according to claim 2, wherein said plurality of protrusions obliquely extend in such a manner that they extend inwardly when said recesses extend outwardly, and they extend outwardly when said recesses extend inwardly.

4. A golf club head according to claim 2, wherein said plurality of protrusions are convex bars provided along the peripheral edge of the balance weight, and said plurality of recesses are concave grooves provided along the peripheral edge of the head body.

5. A golf club head according to claim 2, wherein said balance weight is formed of beryllium copper alloy softer than the material of said head body, whereby plastic deformation can more easily take place in pressing the protrusions into the recesses.

6. A golf club head having a head body and a balance weight being formed annular in cross section and made of a denser material than that of said head body, a back side of said head body comprising three step surfaces:

a first flat surface located around the most outer peripheral edge of said head body, having a first reverse-tapered side-surface bending from an inner periphery of the first flat surface toward the back side;

a second flat surface extending from an end of the first reverse-tapered side-surface toward its inner periphery side, having a second reverse-tapered surface bending from an inner periphery of the second flat surface;

a third flat surface extending from an end of the second reverse-tapered side-surface toward its inner periphery side, having a cylindrical surface extending from the inner periphery of the third flat surface toward the back side, said two reverse-tapered side-surfaces being so provided that the cross sectional width of the stepped portions increases toward the extending direction, and a front side of said weight comprising three inverted step surfaces:

a first flat surface corresponding to said first flat surface of said head body, having a first tapered surface for pressing said first reverse-tapered surface of said head body thereunto;

a second flat surface corresponding to said second flat surface of said head body, having a second tapered surface for pressing said second reverse-tapered surface of said head body thereunto;

a third flat surface corresponding to said third flat surface of said head body; and an aperture for fitting said cylindrical surface of said head body thereunto.

* * * * *